United States Patent [19]

Spadoni, Jr.

[11] 3,980,386

[45] Sept. 14, 1976

[54] ELECTRICAL CONNECTOR WITH MOLDED PIN PROTECTOR

[75] Inventor: Frank G. Spadoni, Jr., Orange, Conn.

[73] Assignee: Litton Systems, Inc., Beverly Hills, Calif.

[22] Filed: Jan. 6, 1975

[21] Appl. No.: 538,889

[52] U.S. Cl. ..... 339/218 M

[51] Int. Cl.[2] ..... H01R 13/40

[58] Field of Search ..... 339/218 R, 218 M, 136 R, 339/136 C, 136 M, 137, 138, 139 R, 139 C, 140 R, 140 C, 141, 142, 278 R; 29/629, 530; 264/273, 318; 174/52 PE; 357/72; 403/265, 266, 267, 268, 269

[56] References Cited

UNITED STATES PATENTS

| | | | |
|---|---|---|---|
| 3,193,794 | 7/1965 | Ege | 339/92 M |
| 3,213,406 | 10/1965 | Just et al. | 339/184 M |
| 3,701,085 | 10/1972 | Graddy et al. | 339/92 M |

*Primary Examiner*—Joseph H. McGlynn
*Attorney, Agent, or Firm*—M. Michael Carpenter; Alan C. Rose; Alfred B. Levine

[57] ABSTRACT

An electrical connector is shown having a pin protector molded into its connector housing. The protector has a plurality of elongated, stamped apertures along one edge formed with offset perimeters which extend into the molded housing for increasing the contact surface between the housing and pin protector molded therein.

5 Claims, 7 Drawing Figures

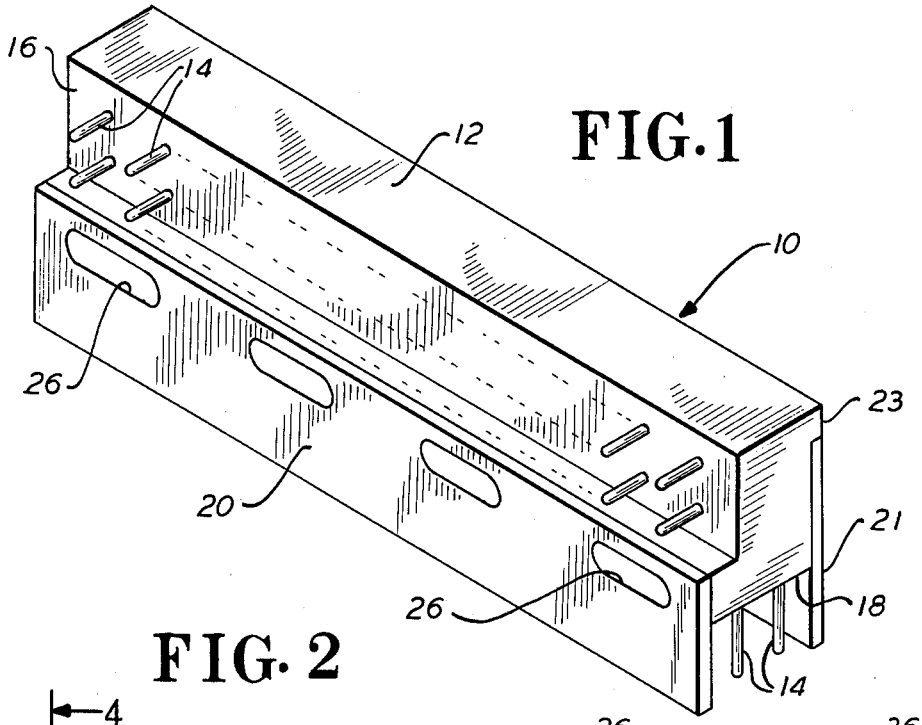
FIG. 1
FIG. 2
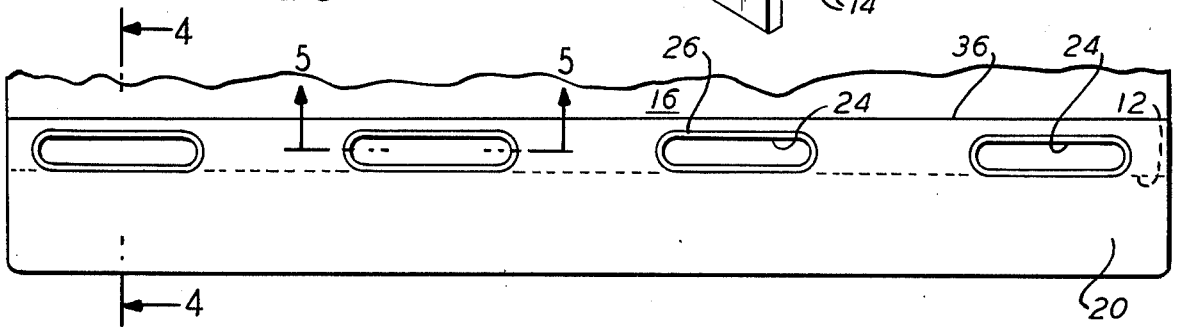
FIG. 3
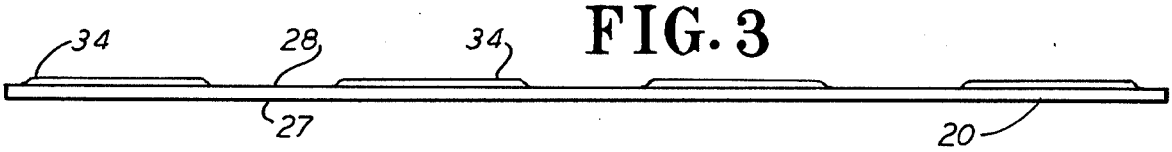
FIG. 4
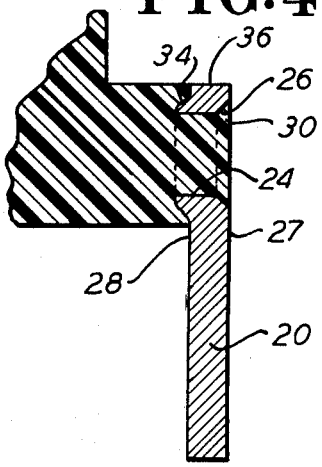
FIG. 5
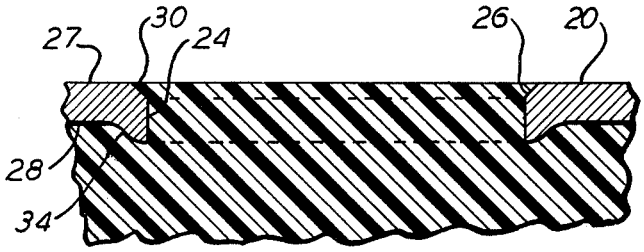

ELECTRICAL CONNECTOR WITH MOLDED PIN PROTECTOR

BACKGROUND OF THE INVENTION

The present invention relates to miniature electrical connectors having a molded pin protector and, more particularly, to an improved method of forming a pin protector and attaching the pin protector to the molded housing of the electrical connector to protect conductive pins mounted within the molded housing of that connector.

Miniaturization of electrical connectors has become more important in the design of electrical circuitry due to the increased miniaturization brought about by solid state electronics such as integrated circuits and hybrid circuits. As these components are reduced in size, the demand for rugged, miniaturized electrical connectors has increased.

Prior art miniature electrical connectors mount conductive pins which, in turn, are placed within apertures in printed circuit boards and electrically secured in the apertures by flow soldering, for example. The conductive pins may be molded into a molded housing with the ends opposite the connection to the printed circuit board extending from the housing for electrical connection with a mating connector either in line or at a right angle to the first-mentioned connector. The mating connector typically mounts conductive sockets which receive the conductive pins and, in turn, is connected to a printed circuit board, a wire cable, wire harness or similar conductive device. Due to the miniaturization of the connector and its conductive pins, it is desirable to protect the pins against bending or other mechanical deformation.

The utilization of a planar pin protector which extends parallel to the axis of the conductive pins is known in the prior art. The present invention was conceived after an attempt was made to bond the pin protector to the sides of the molded housing. Due to miniaturization, the area between the protector and housing was limited. The adhesive failed under pull tests designed to test the bond between the protector and housing. A second attempted solution used countersunk holes which had been used with success where miniaturization did not limit the available area. The second attempted solution also failed the pull test. The limited surface area between the pin protector and the molded housing (0.080 inches wide by 2.0 inches long) greatly contributed to the failures.

SUMMARY OF THE INVENTION

In order to mount the pin protector on the miniaturized electrical connector while meeting the pull-out test, a unique method of mounting the pin protector against the molded housing was conceived. This method elongates the molding apertures to increase the holding surface area between the molded housing and the pin protector. The perimeter of each of the molded apertures is also offset or detented into the molded housing to increase the amount of molding material which flows through the molding aperture to hold the pin protector against the molded housing. The detent provides an additional holding surface for increasing the holding force parallel to the plane of the pin protector.

Accordingly, it is an object of the present invention to provide an improved method of mounting a pin protector against a molded housing.

Another object of the present invention is to provide an improved pin protector mounting configuration which may be molded into a molded housing to withstand destructive forces in two planes parallel to and normal to the plane of the pin protector.

Other objects and advantages of the present invention will become apparent to those skilled in the art after consideration of the following detailed specification in combination with the referenced drawings, wherein:

BRIEF DESCRIPTION OF THE DRAWINGS

FIG. 1 is the perspective view of a miniature electrical connector embodying the present invention;

FIG. 2 is a plane view showing a pin protector mounted on the electrical connector of FIG. 1 shown partially broken away;

FIG. 3 is a top view showing the pin protector of FIG. 2;

FIG. 4 is a cross-sectional view taken through lines 4—4 of FIG. 2;

FIG. 5 is a cross-sectional view taken along lines 5—5 of FIG. 2;

DESCRIPTION OF THE PREFERRED EMBODIMENT

Figure 6:
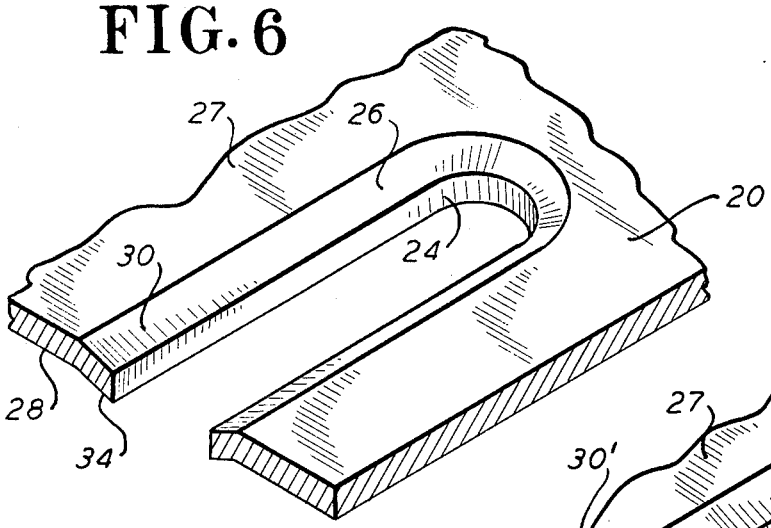
FIG. 6 is a perspective view partially broken away showing a molding aperture within the pin protector of FIG. 2.

Referring now to the drawings, FIG. 1 shows a miniature electrical connector 10 including a molded housing 12 molded from a non-conductive material such as a high strength dielectric, diallylphthalate. Molded into the housing 12 are conductive contact pins 14 which may be formed from phosphor bronze or a brass alloy. In the embodiment shown, the conductive pins 14 pass through the molded housing 12 and are displaced at right angles to emerge from a printed circuit board mounting recess face 16 in two parallel rows of equally spaced contacts. The contacts are placed within apertures in a printed circuit board, not shown, and mounted therein by flow soldering, for example. In other embodiments, the conductive pins 14 may pass straight through the molded housing 12.

The conductive pins 14 also emerge from a connector engaging surface 18 on the molded housing 12 in two parallel rows. As the two rows of pins are exposed, they are susceptible to damage, especially after the miniature electrical connector 10 has been mounted upon a printed circuit board. To protect against such damage, pin protectors 20 and 21 are attached, as by molding, to each side of the molded housing 12. Due to the configuration of the miniature electrical connector 10, it is necessary that the molded connection between the pin protector 20 and the molded housing 12 be flush or in line with the outside surface of a printed circuit board, not shown, which is received by the recess face 16. In the preferred embodiment, the pin protector is one-quarter of an inch wide and approximately two inches long. While the length of the pin connector may vary depending on the number of conductive pins 14 used, the width is generally standardized. The surface area between the molded housing 12 and the pin protector in the present embodiment is only 0.08 inches as best seen in FIG. 2.

Figure 9:
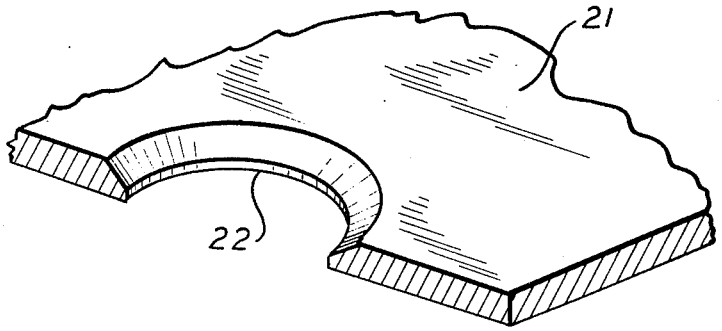
FIG. 9 PRIOR ART
FIG. 9 is a perspective view partially broken away showing an aperture used within a second pin protector of FIG. 2 which represents the prior art.

In prior art arrangements, the juncture between the pin protector 20 and the molded housing 12 was accomplished by bonding and later by the use of countersunk holes such as apertures 22 shown in FIG. 9. Due to the thin sheet metal stock from which the pin protector 20 is formed (0.025 inches) and the narrow mounting area (0.080 inches high), the countersunk aperture 22, when used in protector 21, does not provide enough holding surface to withstand a pull-out test force of six pounds when that force was applied perpendicularly to the plane of the pin protector. This same countersunk aperture 22 is used with success to mount pin protector 21 to the side 23 of the molded housing 12 opposite from recess face 16.

In order to overcome this mounting problem, the present invention provides a plurality of elongated molding apertures 24 within the surface of the pin protector 20 that are stamped into the surface of the pin protector to additionally provide an elongated detent portion 26 surrounding each aperture. The detents 26 extend into the side of the molded housing 12. In the preferred embodiment, each molding aperture 24 is elongated to allow an increased amount of the molding material which forms the molded housing 12 to flow through the aperture and over the detent 26. A typical aperture is 0.25 inches long by 0.047 inches wide.

During the stamping process, the aperture 24 is formed by piercing the pin protector 20 from an outer surface 27 toward an inner surface 28 while at the same time offsetting the outer surface 27 inwardly to form a peripheral shouldered surface 30 around the aperture 24, as best seen in FIGS. 4 and 5. The inner surface 28 of the pin protector 20 is also inwardly offset to form a shouldered surface 34 perpendicularly protruding from the inner surface 28. In the preferred embodiment, the detent portion 26 which is detented about the perimeter of aperture 24 measures 0.270 inches by 0.067 inches. The height of the shoulder 34 which protrudes above the inner surface 28 is, in the preferred embodiment, 0.012 inches; while the depth of the detented portion 26 which forms the inner shoulder surface 30 is 0.010 inches.

Referring now to FIG. 6, it will be seen that the pin protector 20 is formed with a molding aperture 24 having the surrounding perimeter offset by the detent 26. The detent 26 forms a sloping surface 30 which functions as a shoulder to retain the pin protector 20 against forces normal to its surface plane. Additionally, the detent 26 forms the sloping surface 34 which provides a shouldered function to retain the pin protector 20 against forces parallel to its surface plane. The two surfaces 30 and 34 are elongated to provide further strengthening support for the pin protector 20 in a plane normal to the plane of the pin protector 20 as well as parallel thereto. This represents an improvement over the arrangement shown in FIG. 9 wherein there is no equivalent for the elongation of shouldered surfaces 30 and 34 or the shouldered surface 34.

Figure 7:
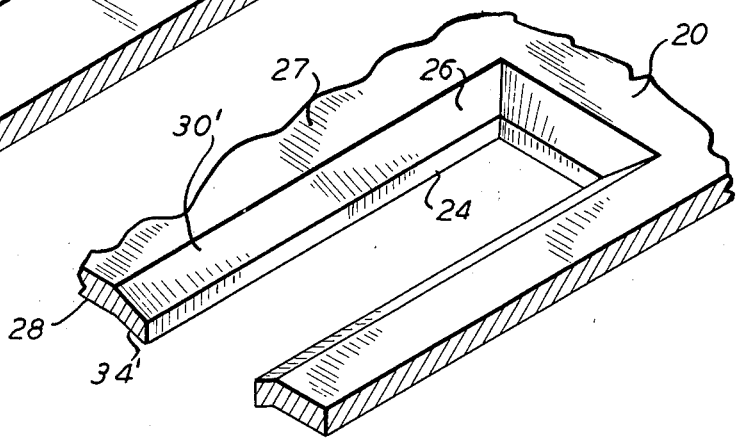
FIGS. 7 and 8 are perspective views partially broken away showing further molding apertures within the pin protector of FIG. 2 embodying the present invention.

Another arrangement of the elongated molding aperture 24 and perimeter detent portion 26 is shown in FIG. 7. As seen, the surfaces 30' and 34' form holding surfaces which withstand destructive forces applied to the pin protector 20 in planes normal and parallel to the plane of the pin protector 20; while the corners of the perimeter portion 26 are squared.

Figure 8:
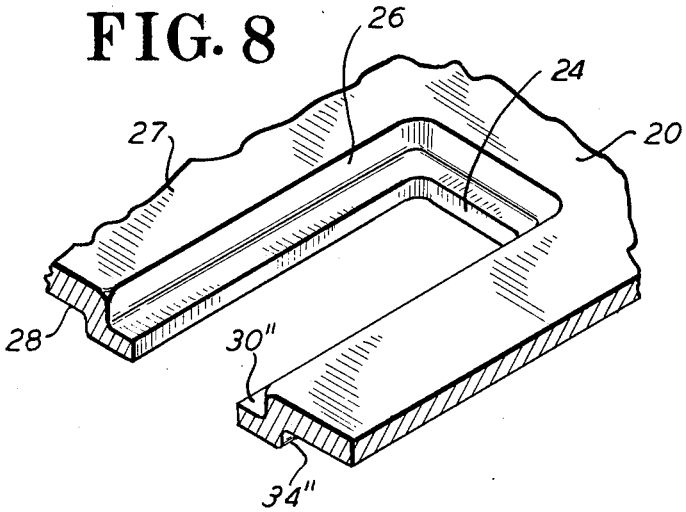

A third embodiment of the molding aperture 24 and the perimeter surrounding detent portion 26 is best shown in FIG. 8. As seen, the surface 30'' is parallel to outer surface 27 to form a uniform molded thickness as the molded material of housing 10 flows through the aperture 24. The surface 34'' is perpendicular to inner surface 28 for maximizing the holding force which reacts to forces applied parallel to the plane of the pin protector. The stamping of the aperture 24 and detent 26 of FIGS. 6, 7 and 8 is extremely close to an upper edge 36 of the pin protector 20, see FIG. 4. One method of preventing the stamping of the aperture 24 and detent 26 from deforming the pin protector 20 along its upper edge 36 is to stamp the pin protector with additional material along the upper edge 36 which can then be sheared from the pin protector 20 after the stamping process.

The arrangement described hereinabove provides a means for increasing the molded bonding forces between the molded housing 12 and the pin protector 20 in a miniature electrical connector 10. Due to the limited space available to connect the pin protector 20 to the molded housing, it is necessary to provide the uniquely arranged molding detents which secure the pin protector against parallel and normal forces applied thereto. It will be understood by those skilled in the art that the preferred embodiment of the pin protector shown may be modified to provide other variations.

The embodiments in the invention in which an exclusive property or privilege is claimed are defined as follows:

1. A miniature electrical connector comprising:

a molded housing;

a plurality of conductive pins mounted in said molded housing;

a planar pin protector mounted on said molded housing having first and second opposing parallel planar surfaces with a plurality of elongated apertures therein;

said planar pin protector having internally offset perimeter forming portions extending from the plane of said planar pin protector toward said elongated apertures therein to form first and second parallel housing engaging shouldered surfaces integral with said first and second opposing parallel planar surfaces and extending out of said planes of said surfaces and into said molded housing to terminate at the perimeter of each of said apertures; and said molded housing having pin protector engaging surfaces molded around and through said elongated apertures for engaging said first and second parallel housing engaging shouldered surfaces and retaining said pin protector on said housing against forces normal and parallel to the plane thereof.

2. A miniature electrical connector as claimed in claim 1 wherein said internally offset perimeter forming portions that form first and second parallel housing engaging shouldered surfaces are offset at an angle to said first and second opposing parallel planar surfaces of said planar pin protector.

3. A miniature electrical connector as claimed in claim 1 wherein said internally offset perimeter forming portions that form first and second parallel housing engaging shouldered surfaces are offset into a second plane parallel to said planar pin protector wherein a portion of said first parallel housing engaging shouldered surface is parallel to said planar pin protector and a portion of said second parallel housing engaging shouldered surface is perpendicular to said planar pin protector and extends into said molded housing.

4. A miniature electrical connector as claimed in claim 1 wherein each of said elongated apertures is five times longer than its width and each of said internally offset perimeter forming portions is four times longer than its width.

5. A miniature electrical connector as claimed in claim 1 wherein said planar pin protector is first formed with an inner surface line parallel and closely spaced to said elongated apertures and said internally offset perimeter forming portions formed within said planar pin protector and then separated along said inner surface line to form an outer edge of said planar pin protector closely spaced to said apertures and offset portions.

* * * * *